US008286476B2

(12) United States Patent
Montaron et al.

(10) Patent No.: US 8,286,476 B2
(45) Date of Patent: Oct. 16, 2012

(54) DOWNHOLE 4D PRESSURE MEASUREMENT APPARATUS AND METHOD FOR PERMEABILITY CHARACTERIZATION

(75) Inventors: Bernard Andrew Montaron, Saint Marcel-Paulel (FR); Fikri John Kuchuk, Meudon (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/281,412

(22) Filed: Oct. 25, 2011

(65) Prior Publication Data

US 2012/0186809 A1 Jul. 26, 2012

Related U.S. Application Data

(62) Division of application No. 12/132,728, filed on Jun. 4, 2008, now Pat. No. 8,113,044.

(30) Foreign Application Priority Data

Jun. 8, 2007 (EP) ..... 07109870

(51) Int. Cl.
*E21B 47/01* (2006.01)
*E21B 47/06* (2006.01)

(52) U.S. Cl. ..... 73/152.51; 166/250.11

(58) Field of Classification Search ..... 73/152.02, 73/152.07, 152.51, 152.67; 166/250.11
See application file for complete search history.

(56) References Cited

U.S. PATENT DOCUMENTS 5,160,226 A 11/1992 Lee, II
5,467,823 A 11/1995 Babour et al.
5,549,159 A 8/1996 Shwe et al.
5,692,565 A 12/1997 MacDougall et al.
5,695,008 A 12/1997 Bertet et al.
5,779,085 A 7/1998 Havlinek et al.
5,875,840 A 3/1999 Dietle
6,003,557 A 12/1999 Brelig et al.
6,070,662 A 6/2000 Ciglenec et al.
6,234,257 B1 5/2001 Ciglenec et al.
6,283,209 B1 9/2001 Keller
6,426,917 B1 7/2002 Tabanou et al.
6,467,387 B1 10/2002 Espinosa et al.
6,538,576 B1 3/2003 Schultz et al.
6,691,779 B1 2/2004 Sezginer et al.
6,693,553 B1 2/2004 Ciglenec et al.
6,766,854 B2 7/2004 Ciglenec et al.
6,863,127 B2 3/2005 Clark et al.
6,864,801 B2 3/2005 Tabanoou et al.
6,896,074 B2 5/2005 Cook et al.
6,943,697 B2 9/2005 Ciglenec et al.
6,978,833 B2 12/2005 Salamitou et al.
7,040,402 B2 5/2006 Vercaemer
7,082,998 B2 8/2006 Zamora et al.
7,111,685 B2 9/2006 Fields
7,140,434 B2 11/2006 Chouzenoux et al.
(Continued)

FOREIGN PATENT DOCUMENTS

EP 1764475 2/2009
(Continued)

*Primary Examiner* — John Fitzgerald
(74) *Attorney, Agent, or Firm* — Stephanie Chi

(57) ABSTRACT

A method of installing a sensor system for making pressure measurements in downhole formations surrounding a wellbore includes placing a sensor in direct pressure communication with the formations from a predetermined position in the wellbore; and isolating the sensor with an elastomeric sealing means placed against the formation wall in order to prevent hydraulic pressure communication between the sensor and the inside of the wellbore.

13 Claims, 4 Drawing Sheets

U.S. PATENT DOCUMENTS

| | | | |
|---|---|---|---|
| 7,278,480 | B2 | 10/2007 | Longfield et al. |
| 2004/0182147 | A1 | 9/2004 | Rambow et al. |
| 2004/0207539 | A1 | 10/2004 | Schultz et al. |
| 2004/0238165 | A1 | 12/2004 | Salamitou et al. |
| 2004/0238166 | A1 | 12/2004 | Salamitou et al. |
| 2006/0005965 | A1 | 1/2006 | Chouzenoux et al. |

FOREIGN PATENT DOCUMENTS

| | | |
|---|---|---|
| GB | 2398810 | 9/2004 |

DOWNHOLE 4D PRESSURE MEASUREMENT APPARATUS AND METHOD FOR PERMEABILITY CHARACTERIZATION

CROSS-REFERENCE TO RELATED APPLICATION

This application is a divisional application of U.S. patent application Ser. No. 12/132,728 Jun. 4, 2008, now U.S. Pat. No. 8,113,044.

TECHNICAL FIELD

This invention relates to pressure measurements in formations surrounding boreholes such as oil, water or gas wells or the like. In particular the invention relates to pressure measurements with sensors suitable for temporal monitoring downhole formation properties.

BACKGROUND ART

It is known to make formation pressure measurements at different depth intervals in a wellbore. The classical pressure measurement has been made with a borehole logging sonde. However, the problem with this technique is that the sonde is sensitive to borehole fluid effects. This means that the measured pressure can contain components from both the formation and the borehole fluid but the relative contribution of each can be difficult to determine.

U.S. Pat. No. 7,140,434 discloses a conventional sensor system having a smart plug 11 with embedded sensors 12 inside a cemented casing 16, 18; see FIG. 1. The sensor 12 is sealed in the hole in the casing 16, 18 such that there is no fluid communication between the inside and the outside of the casing 16, 18 through the hole. The sensors 12 are in direct contact with the formation 10 and insulated from the borehole fluids. The plug sealing in the casing wall is key since leakage will affect integrity of the casing 16, 18 and lead to misinterpretation of pressure measurement. The sensor 12 must be insulated from pressure variations inside the casing 16, 18. However, this system still has problems concerning the inference of formation properties.

The production of a well must be monitored and controlled to maximize the production over time since production parameters afford data that define the possible yield of the reservoir. Production levels depend on reservoir formation characteristics such as pressure, temperature, permeability, porosity and the like. In particular, a concern in reservoirs is the inference of formation properties from time varying measurements, for example, monitoring time varying pressure at a number of sensors over a period of time. In this case, sparse measurements of pressure and flow rates in limited number of wells result in an incomplete and uncertain set of measurements. This is attributable to noise in the measurements (particularly reservoir pressure, well production profiles, and water cut in commingled systems) and area heterogeneity. This results in an incorrect inference of formation properties.

The use of interference tests (using single or multiple pressure pulses) for determining formation characteristics such as permeability is now well established. However, almost all applications of interference testing suffer because of the variation of formation properties, particularly permeability distribution, in the vertical direction. Furthermore, the formation pressure signature is usually lost in a multilayer environment when it comes into a commingled wellbore.

While the use of 1D transient well testing (conventional drawdown, buildup, and interference tests) and 3D measurements, made as a function of time as reservoir is depleted, has improved the industry's understanding of well productivity, there still remains a need for an improved inference of formation properties.

There has been a long desire for reservoir engineers to have permanent sensors behind the casing embedded in earth formations. Existing methods of placing permanent sensors behind casing are difficult, cumbersome and not readily applicable. In U.S. Pat. No. 5,467,823 the sensors are placed outside of the casing along with a perforation charge. The sensors communicate with the surface via cables running outside of the casing. The casing and the cables are run in hole and a cementing operation is performed. After cementing, the perforation charges are initiated to perforate through the cement and into the formation so that the sensors communicate with the earth formations. This is a difficult operation and suffers from:

a) cables running outside of the casing, making perforation for production difficult;

b) cement integrity can be questionable, thus the sensors can all be in communication with each other, not reading individual layer properties;

c) the perforation charges may damage sensors and jeopardize cement integrity; and d) further cased hole logging can be compromised due to cable and sensor presence behind the casing.

An object of the invention is to provide a technique to isolate the reservoir sensor from the wellbore fluids and to effectively and efficiently measure pressure in formations about wellbores for reservoir characterization in oil and gas fields or the like to allow reliable production forecasts and sound reservoir management.

A further object is to attempt to provide a complete set of spatial dynamic measurements for determination of permeability distribution, pressure, and saturation using 4D transient pressure well testing, coupled with the traditional reservoir monitoring about wellbores, particularly open wells.

A still further object of the invention is to define a methodology for pressure sensor placement.

This invention is based on the recognition that it is important to ensure good pressure communication between the sensor and the formation while at the same time isolating the sensor from pressure effects due to the borehole.

DISCLOSURE OF THE INVENTION

A first aspect of the invention comprises a system for making pressure measurements in a formation surrounding a wellbore, comprising:

- a sensor which, in use, is positioned into direct pressure communication with the formation from a predetermined location in the wellbore;
- means for isolating the sensor, when in use, from pressure effects arising from the wellbore.

A second aspect of the invention comprises a method of installing a sensor system for making pressure measurements in downhole formations surrounding a wellbore, comprising:

- placing a sensor in direct pressure communication with the formations from a predetermined position in the wellbore;
- and isolating the sensor with an elastomeric sealing means placed against the formation wall in order to prevent hydraulic pressure communication between the sensor and the inside of the wellbore. The method further comprises receiving pressure measurement data to a data acquisition means transmitted from the sensor; and interpreting data from a data interpretation means.

By placing the sensor in 'direct' pressure communication with the formation, i.e. there is no intermediate barrier between the formation pressure and the sensor, distortions of the pressure measurement are reduced. By isolating the sensor from the wellbore pressure effects, the output of the sensor provides a 'cleaner' measurement of the formation pressure.

The system can comprise multiple sensors, one or more means for isolating the sensors from wellbore pressure effects being provided. In one embodiment, a separate means is provided for each sensor.

In one preferred embodiment, the isolating means comprises an elastomeric sealing means placed against the formation wall isolating the sensor means in order to prevent hydraulic pressure communication between the sensor and the interior of the wellbore.

One or more sensors can be pre-mounted in the elastomeric sealing means before being installed in the wellbore.

The pressure measurements are conducted in downhole formations surrounding an open hole wellbore but also outside the casing of a cased wellbore. The measurements may also be conducted in lateral boreholes in the formations, extending perpendicular to the main downhole direction, and in non-vertical or horizontal boreholes using lateral perforations or drainholes (see, for example, EP 1764475 for drilling lateral boreholes from a main borehole).

Preferably, there is a permanent communication link between the sensor means and the formation wall, and preferably, the link can be electrical wires, optical fibres, wireless or a combination of a hardwired connection between surface and downhole and an electro-magnetic communication link over a short distance.

The material for the isolating means is preferably transparent to electro-magnetic waves, being made from materials such as rubber, resin fibre, plastic tube, (in expanded and/or polymerized forms). The sealing means can have a wellbore lining of a low permeability material, preferably cement.

In another embodiment, the isolation is achieved by the use of fluids with or without the use of liners. The fluids are preferably water, acid, cement slurries or heat generating mixtures. In one embodiment, the sensor can be positioned in a cement composition which degrades to give direct pressure contact with the reservoir while a permanent cement provide pressure isolation from the wellbore.

The system can be installed in one or more wells of an oil and/or gas field, monitoring pressure measurements over time from all the installed sensors while generating pressure pulses in one or more surrounding wells so as to perturb the pressure in the reservoir.

The system preferably further comprises data acquisition means receiving data from the sensors; and a data interpretation means for deriving reservoir properties from the acquired data.

In one particularly preferred embodiment, the method comprises positioning the sensor in the formation wall, expanding an elastomeric sealing means and pressing it against the formation wall, and heating the sealing means to set a composite material contained in the sealing means.

Preferably, the step in the method of isolating the sensor with an elastomeric sealing means comprises: 1) inserting a laying tool comprising an inflatable die; 2) inflating the die causing the sealing means to expand and press against the formation wall; 3) heating the die to set the composite material within the sealing means; 4) deflating the die while leaving the sealing means in place; and 5) removing the laying tool.

The system can comprise an array comprising one or more sensors disposed at various points along the wellbore, preferably projecting into the formations. Also, although a single well may be enough for permeability characterization for a given well drainage area, more than one may be required in an area where there is uncertainty and area heterogeneity.

An apparatus for injecting an isolation fluid inside the perforation or drainhole containing the sensor, comprises:

- a tank containing an isolation fluid;
- a motor;
- a piston operated by the motor to eject fluid from the tank; and
- anchors for anchoring the apparatus in position in the wellbore.

The isolation fluid can be water, acid, heat generating material, cement slurry, cement, resin compound, and preferably is an epoxy resin compound. The fluid may additionally comprise magnetic components or additives to facilitate signal communication with the sensor.

The apparatus can be used to seal a liner deployed inside perforations or drainholes. Sensors or any other devices for reservoir monitoring can be implemented in liners or sensor insertion tubes. The apparatus can be used to fill one or more drainholes at the same time.

One method of installing sensors according to the invention comprises:

a) drilling a hole in the wellbore wall at a predetermined location to form a drainhole;
b) positioning an installation apparatus at the same level as the drainhole;
c) anchoring the apparatus in the wellbore;
d) inserting a liner pre-equipped with sensors from the apparatus into the drainhole;
e) injecting an isolation fluid from the apparatus into the drainhole to surround the sensor; and
f) solidifying the isolation fluid.

MODE(S) FOR CARRYING OUT THE INVENTION

The present invention addresses full spatial distribution measurements, for example for pressure measurements, in order to infer important formation properties, such as permeability and saturations to adequately assess the reservoir and make predictions. Interpretations of this kind typically constitute what are called inverse problems. Finding solutions of inverse problems is a particularly difficult task because of non-uniqueness. Non-uniqueness means in effect that the true solution cannot be selected among a large set of possible solutions (realizations) without further constraints imposed. For the permeability characterization, a well or wells must therefore provide dynamic measurements that must be spatially distributed in three dimensions in order to determine its spatial distribution.

In order to carry out a better and unique reservoir characterization, the present invention provides a new 4D pressure measurement system for a single well and multiple well interference testing technique to determine the permeability distribution of the interior region of the reservoir. In general, only one well among a few surrounding wells need be equipped with a number of vertically distributed pressure sensors that are implanted in the formation for 4D well testing. The number of vertically distributed pressure sensors depends on the expected variation of the vertical permeability. If there are many layers (flow units) with contrasting permeability, the number of the sensors can be increased. If there are very few layers, only a few sensors in each well are needed. One pressure sensor measuring the wellbore pressure in each surrounding well should also be implanted or measurements can be carried out with conventional testing or production testing tools.

For example, for a three-layer reservoir, three permanent pressure sensors in the central well with pressure measurements in the surrounding wells will provide measurements for a well-defined inverse problem of permeability distribution, provided that the properties of the formation around the wellbore are well defined by open-hole logs. Further, the faults and main geological characterizations of the formation will be defined by integrating 4D pressure and production data with other geoscientific data (seismic and depositional environment, etc.).

Figure 2:
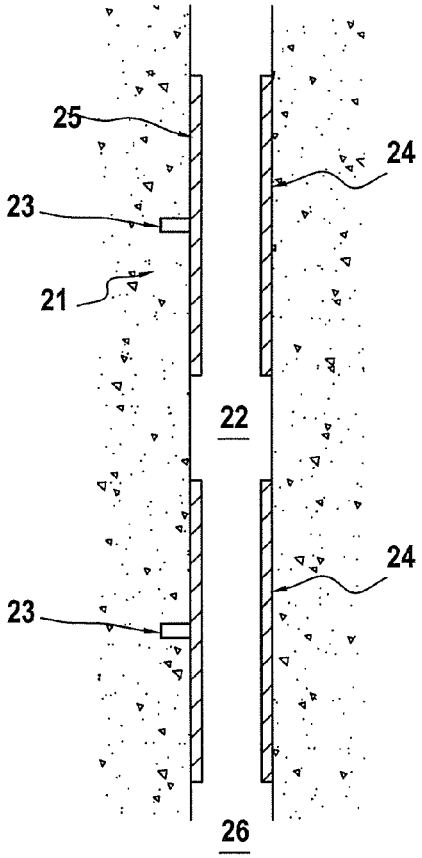
FIG. 2 illustrates a schematic cross sectional view according to the first aspect of the present invention depicting an apparatus to make pressure measurements.

FIG. 2 illustrates a schematic cross sectional view of the apparatus 21 of the present invention for measuring pressure in an openhole section of the wellbore 22.

Figure 1:
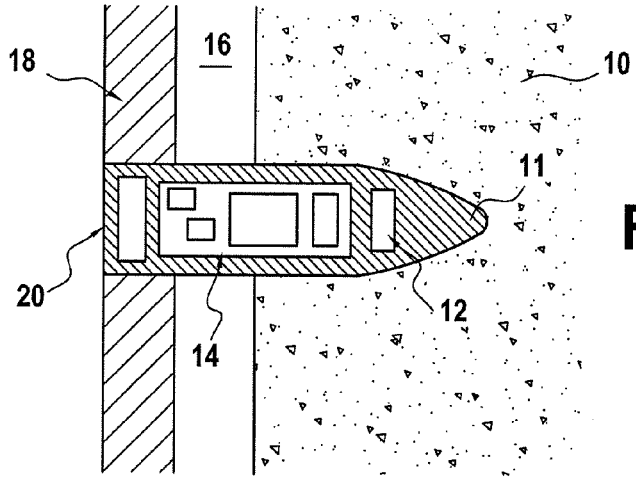
FIG. 1 illustrates a general view of a conventional sensor plug.

The apparatus 21 comprises a sensor 23 and a sealing means 24. The sensor 23 can be any known pressure sensor, for example the conventional sensor plug depicted in FIG. 1.

The sensor 23 can be mounted using, e.g., a cased hole drilling tool (e.g. the CHDT of Schlumberger) with an open hole kit, a coring tool or smart plug type technology or any equivalent.

The sensor 23 is preferably mounted at various locations about the formation wall 25 of the wellbore 26, including in or outside the formation wall or in the vicinity of the formation. Also, the sensor 23 can be mounted in a casing, including in or outside the casing or in the vicinity of the casing. The sensor 23 can also be embedded in the formation. The sensor 23 can be positioned in or about the formation at any suitable angle with respect to the formation wall, and preferably the sensor 3 is positioned at right angles to the formation wall.

The sealing means 24 is positioned about the formation, preferably, along the formation wall 25 in the wellbore isolating the sensor 23 so as to follow the contour of the inside wall of the formation. The sealing means 24 can also be placed in any other suitably adjacent position against the formation in the wellbore including any respective angle of inclination, and is preferably at right angles with respect to the sensor 23.

The sealing means 24 must be suitably selected so as to prevent hydraulic communication between the sensor 23 and the wellbore. This is achieved by creating a physical flow barrier (a no-flow boundary) to isolate the sensor 23 from the wellbore 26 that allows certain signals to pass from the sensor to the communication data acquisition while at the same time making pressure measurements insensitive to well pressure and provide a true reservoir pressure measurement in open hole wells.

Any suitable physical flow barrier material can be used, preferably comprising an elastomer, and more preferably comprising a flexible composite material. Preferably, the material for the sealing means should be transparent to electro-magnetic waves. The sealing means is preferably selected from rubber, resin fibre, plastic tube, (expanded and/or polymerized).

One can also use a layer of an appropriate chemical product to create the wellbore lining, for example by using a relatively low permeability material, preferably cement.

Preferably, Patchflex technology is used for sealing, see for example U.S. Pat. No. 5,695,008. This technique uses a flexible composite material made of carbon fibre, thermosetting resins and a rubber skin. The material, for example in the form of a patch or sleeve, is built around an inflatable setting element that is attached to a running tool and run into a well on a wireline. When the patch is positioned opposite the sensor 23 to be isolated, a pump within the running tool inflates the sleeve. The resins are then heated until fully polymerized. The inflatable setting element is then deflated and extracted to leave a hard, pressure-resistant patch that isolates the sensor 23.

The amount of Patchflex required for sealing can be variably sized sufficient to effectively isolate the sensor 23, and in particular can have a variable height along the formation wall. The height can be evaluated according to the vertical permeability of the rocks.

In another embodiment of the present invention, the sealing means 4 is pre-mounted with the sensor 23, power and communication system at its outer surface before placement along the formation wall. The sealing means 24 may be premounted to the sensor 23 using any suitable attaching means, for example, any suitable adhesive or mechanical means. Preferably, the sensor 3 is embedded on the outer surface of a Patchflex type sealing material wherein the outer surface of the sealing material provides mechanical support to the embedded sensors.

Figure 3:
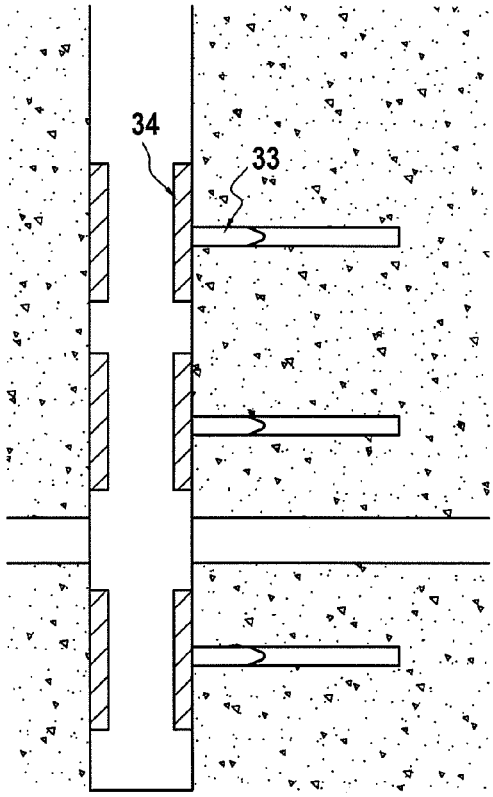
FIG. 3 illustrates a schematic cross sectional view according to the third aspect of the present invention depicting a system to make pressure measurements.

FIG. 3 illustrates a schematic cross sectional view according to an embodiment of the present invention depicting a system to make pressure measurements. The can be a multiple number of sensors 33 and sealing means 34 positioned in any suitable array about the formation in the wellbore. Preferably, the array as shown in FIG. 3 is used wherein the sensor/sealing means are distributed periodically downhole in the vertical direction although the array can also be random. The array can comprise any combination of sealing means pre- or post-attached, including a periodic arrangement or a random arrangement.

The method of operation will now be described. The first step involves pressure communicating a sensor with the formations. For example, this can occur by the placement of any suitable smart pressure plug or similar sensor in or about the formation of an open hole well or casing, using an appropriate tool (e.g. cased hole drilling tool CHDT on wireline). Distributed reservoir sensors can also be incorporated for a completed well, uncompleted well or while completing the well.

The second step involves isolating the sensor means with an elastomeric sealing means placed against the formation wall in order to prevent hydraulic communication between the sensor means and the wellbore. For example, this can occur by the placement of any suitable pressure barrier preventing direct hydraulic communication between the volume of formation in the vicinity of the smart plug and the wellbore while simultaneously allowing the pressure barrier to communicate with a data acquisition system.

The second step can comprise the following steps: 1) inserting a laying tool comprising an inflatable die; 2) inflating the die causing the sealing means to expand and press against the formation wall; 3) heating the die to set a composite material within the sealing means; 4) deflating the die while leaving the sealing means in place; and 5) removing the laying tool.

The third step comprises receiving communication to a data acquisition means transmitted from the sensor; and analysing data from a data interpretation means.

In another embodiment, the method involves pressure communication with the formations taking place with the sensor having a pre-mounted sealing means. The first step comprises pre-equipping a sealing means 34 with the sensor 33, power and communication system at its outer surface, thereby isolating a specific layer in the open-hole well and providing mechanical support for to the embedded sensors. The second step comprises installing the sealing means 34 which is pre-equipped with the sensors 33. Any reservoir fluid or rock characteristics can then be sensed and these measurements can be distributed in an open hole well, by the installation of several sealing patches.

In another embodiment, the sealing means used to isolate the sensor in order to prevent hydraulic pressure communication with the formations can be any isolation fluid.

The fluid could be water, acids, cement slurries or heat generating mixtures.

Figure 4:
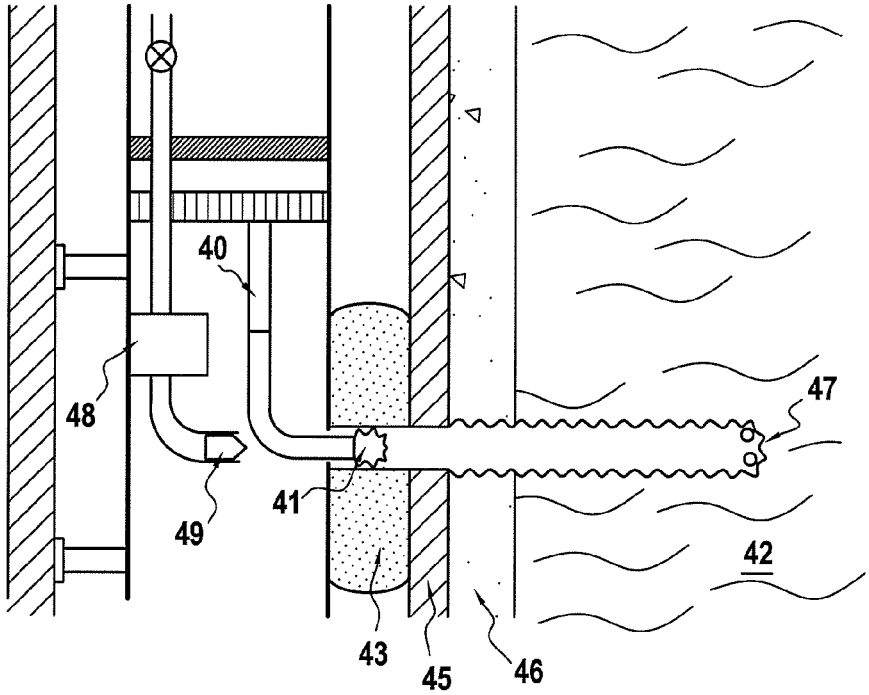
FIG. 4 illustrates the drilling system of another embodiment of the invention.

A drilling system suitable for use in this invention is shown in FIG. 4. This system is similar to the CHDT of Schlumberger and comprises a powered drilling shaft 40 carrying a drill bit 41 at its end. The drill bit 41 is forced into the formation 42 by the shaft 41 through a hole in a packer assembly 43 which is urged against the wellbore wall by means of backup arms 44. The drill bit 41 can drill through the casing 45 and cement 46 lining the wellbore to drill a hole 47 in the formation 42. A sensor delivery system 48 is also included in the tool, carrying one or more sensor assemblies 49 and being connected to pump and chamber systems (not shown) above and or below the drilling system for providing fluid.

The sensor assembly 49 may have pressure, resistivity, temperature or seismic sensors. It may contain an antenna to establish two way communications to generate power and to transmit its measurements. It can be powered up later by a wireline tool and/or interrogated periodically with a wireline tool. It may also have battery/memory sections for continuous transmission/recording of data.

Figure 5:
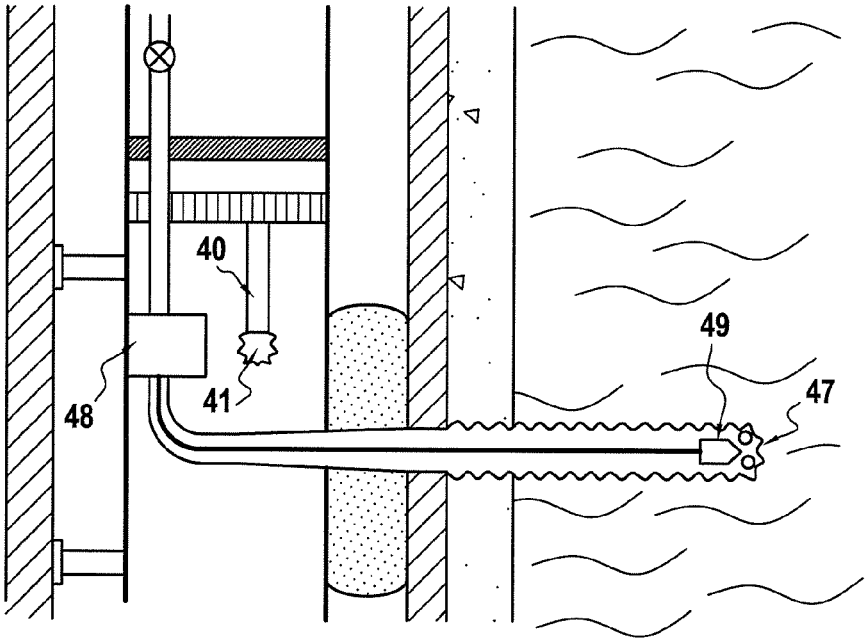
FIG. 5 illustrates the sensor placement in the drilling system of another embodiment of the invention.
Figure 6:
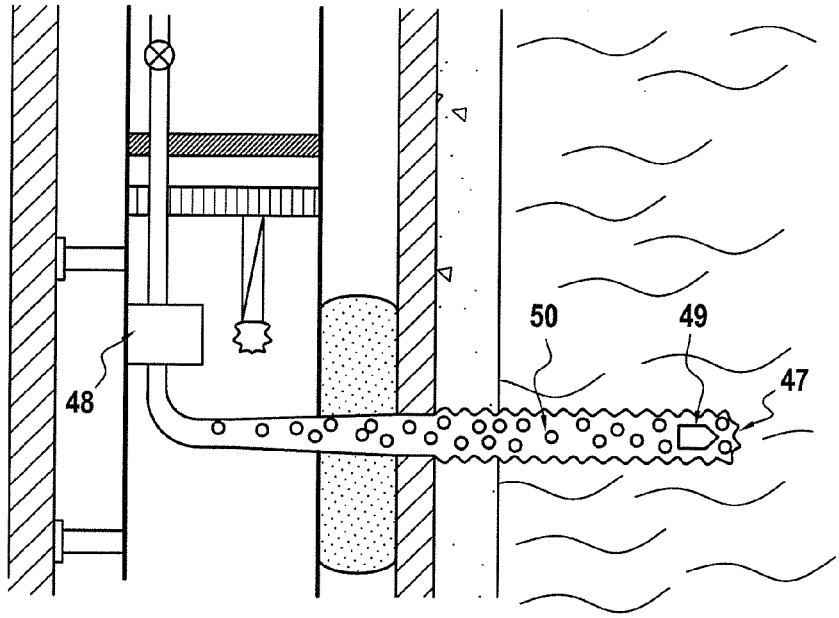
FIG. 6 illustrates injection of isolation fluid in the drilling system of another embodiment of the invention.

In use, following drilling of the hole 47, the drill shaft 40 and drill bit 41 are withdrawn and the sensor delivery system 48 connected to the hole 47. The sensor 49 can then be delivered into the hole 47 by use of fluid pressure or a pusher rod. (FIG. 5). Once the sensor 49 is in place, sealing fluid 50 is delivered into the hole from the sensor delivery system 48 by via a connection to a supply of an appropriate sealing fluid and pumping system (not shown) (FIG. 6).

Essentially the same system can be used in open hole, the packer 43 being urged against the open wall of the wellbore and the drill bit 41 drilling straight into the formation 42.

This embodiment of the invention involves drilling into the formation in open or cased hole and then inserting a sensor assembly. The drilling assembly can be a cased hole drilling tool (CHDT) or CHDT-open hole kit (see above), a rotary coring tool or any device that can drill deeper into the open hole section. Several holes can be drilled in one run and sensors placed and isolated. Sensor insertion can be done mechanically using a flex shaft or can be a combination of mechanical and hydraulic action. The sensor can be initially grabbed from its storage place mechanically, placed in the insertion tube. Then it can be pushed deep inside the hole by the hydraulic action of the injection material. Once the sensor assembly is inserted, it is necessary to isolate it inside the formation, while maintaining hydraulic connectivity with its surrounding rock. One method for isolation is to inject fluids. A first fluid will surround the sensor at the tip and when solidified, can be porous and permeable. If desired a second fluid, which follows the first one will be injected, which will age into a plug with no permeability in the drilled hole, thus achieving hydraulic isolation of the sensor from the wellbore. The fluids can include cement or resin fluids which solidify under temperature with time. The injected isolation fluids can have suitable magnetic additives to facilitate communication with an interrogating antenna.

Figure 7:
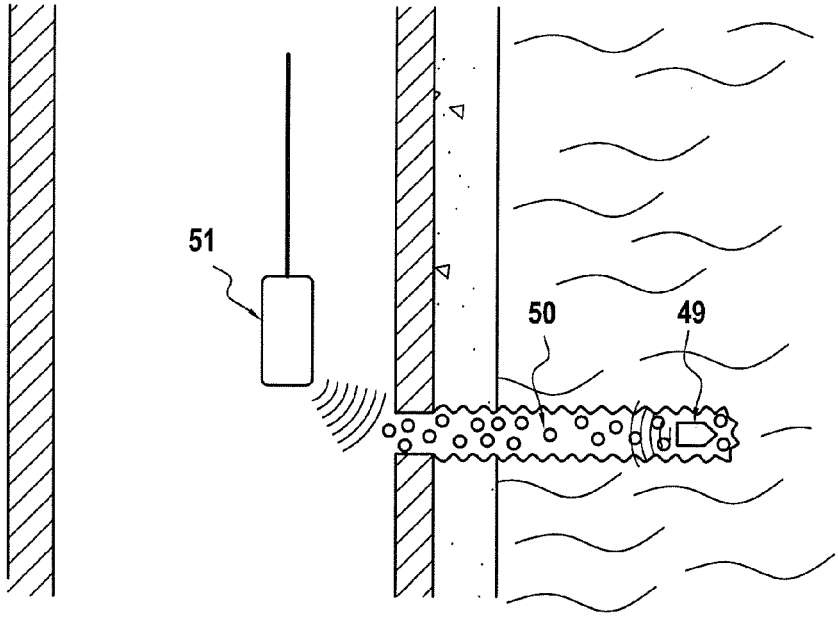
FIG. 7 illustrates interrogation of the sensor assembly in the drilling system of another embodiment of the invention.

When the sensors are placed in open hole, the well then can subsequently be cased or even left open hole, with sensors placed in selected formations. Communication with the sensors can be done with a wireline interrogation tool 51 with periodic interventions into the borehole (FIG. 7). The wireline interrogation tool 51 can supply energy: a) to power up the tool; b) to recharge battery; c) download data stored in the downhole memory; and d) passively read the measurements at that specific time. The injected fluid 50 which solidifies may have properties to enhance this communication link between the wireline interrogation tool 51 and the sensor assembly 49.

Figure 8:
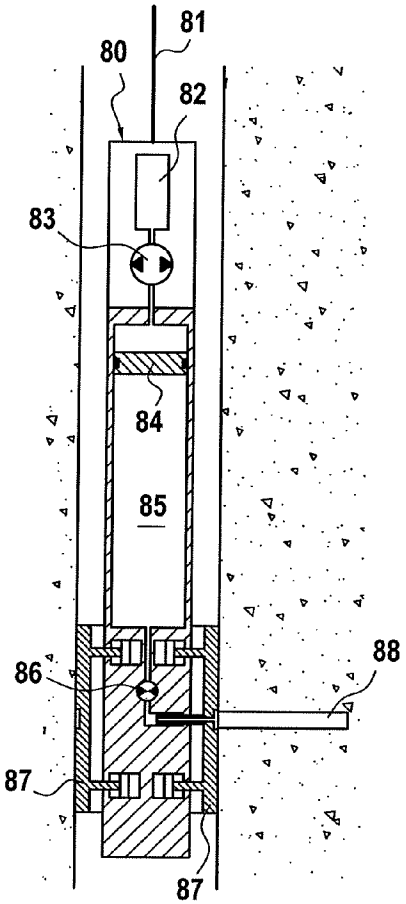
FIG. 8 illustrates an apparatus for filling up a lateral drainhole in another embodiment of the invention.

In another embodiment, there is provided an apparatus and method to seal a liner deployed inside a lateral drainhole. FIG. 8 shows the wireline apparatus to seal liners inside drainholes on which sensors or any other device for reservoir monitoring are implemented. The apparatus can be used to fill up, partially or completely, lateral perforations or drainholes 88 with cement or resin compounds. The apparatus comprises a power supply by a wireline electrical cable 81, a motor drive 82, a pump 83, piston 84 located in a cylinder 85 (containing cement or resin), valve 86 and tool pads 77.

Figure 10:
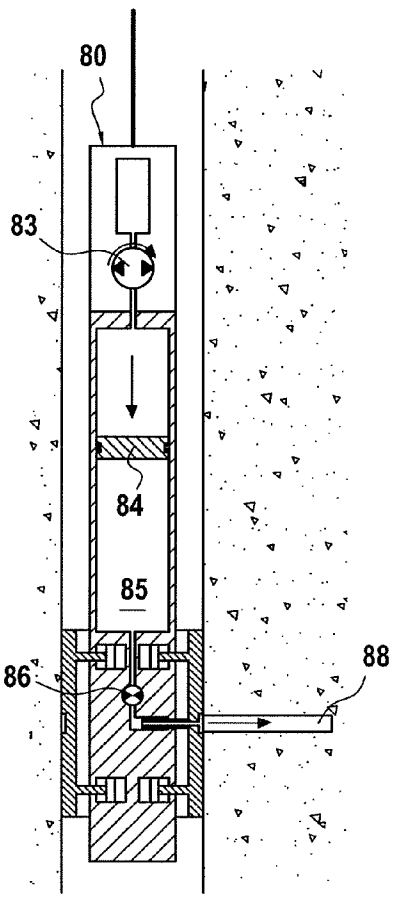
FIG. 10 illustrate the operation of injecting of a compound inside the drainhole.
Figure 9:
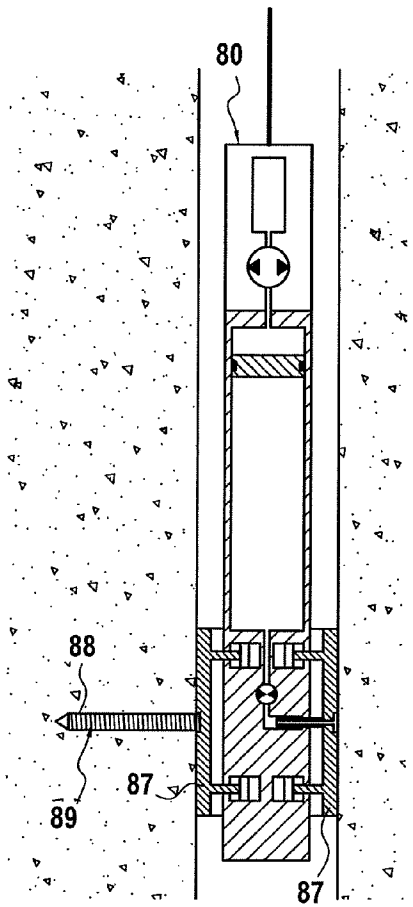
FIG. 9 illustrates the injection of a compound in a drainhole equipped with a liner in another embodiment of the invention.

FIGS. 9 and 10 show the method of injecting a fluid into a drainhole 88 with a liner 89. Step one comprises drilling a hole to form the drainhole 88. Step two comprises positioning equipment 80 at the same level as the drainhole 88. Step three comprises anchoring the equipment 80 with expandable seal pads 87. The pads are activated by hydraulic pressure generated by pump 83 and electro-hydraulic control devices which govern the movement of linked pistons with the pad allowing the opening till anchoring. Step four comprises inserting liner 89 (with or without sensors) into the drainhole 88. Step five (FIG. 10) comprises injecting compounds (cement or resins) into the drainhole 88 by activating a set of valves 86, pumps 83 and pistons 84. By operating valve 86 a pressure is generated via pump 83. Piston 84 is separates a pressure chamber from compound chamber (cylinder 85). The pressure applied to the piston 84 generates the displacement of the piston 84 to push the compound into the drainhole 88.

Other changes may be made to the techniques described above while still remaining within the scope of the invention.

The invention claimed is:

1. A method of installing a sensor system for making pressure measurements in downhole formations surrounding a wellbore, comprising:

placing a sensor in direct pressure communication with the formations from a predetermined position in the wellbore;

and isolating the sensor with an elastomeric sealing means placed against the formation wall in order to prevent hydraulic pressure communication between the sensor and the inside of the wellbore.

2. A method as claimed in claim 1, wherein the step of the isolating the sensor is achieved by the use of fluids with or without the use of liners.

3. A method as claimed in claim 1, further comprising positioning the sensor in the formation wall, expanding an elastomeric sealing means and pressing it against the formation wall, and heating the sealing means to set a composite material contained in the sealing means.

4. A method as claimed in claim 3, wherein the step of isolating the sensor with an elastomeric sealing means comprises:

1) inserting a laying tool comprising an inflatable die;
2) inflating the die causing the sealing means to expand and press against the formation wall;
3) heating the die to set the composite material within the sealing means;
4) deflating the die while leaving the sealing means in place; and
5) removing the laying tool.

5. A method as claimed in claim 1, wherein the step of isolating the sensor comprises injecting an isolation fluid around the sensor.

6. A method as claimed in claim 5, wherein the isolation fluid comprises water, acid, heat generating material, cement slurry, cement, or a resin compound, epoxy resin compound and optionally comprises magnetic components or additives to facilitate signal communication with the sensor.

7. A method as claimed in claim 5, wherein the step of injecting the isolation fluid is performed using an apparatus comprising:

a tank containing an isolation fluid;

a motor;

a piston operated by the motor to eject fluid from the tank; and anchors for anchoring the apparatus in position in the wellbore.

8. A method as claimed in claim 7, further comprising:

a) drilling a hole in the wellbore wall at a predetermined location to form a drainhole;
b) positioning an installation apparatus at the same level as the drainhole;
c) anchoring the apparatus in the wellbore;
d) inserting a liner pre-equipped with sensors from the apparatus into the drainhole;
e) injecting an isolation fluid from the apparatus into the drainhole to surround the sensor; and
f) solidifying the isolation fluid.

9. A method of making pressure measurements in formations surrounding a wellbore comprising:

installing one or more sensors in the formations as claimed in claim 1;

detecting the formation pressure at each sensor over time to produce a series of pressure measurements; and communicating the series of measurement from each sensor to a data acquisition system via the wellbore.

10. A method as claimed in claim 9, further comprising conducting the measurements in lateral boreholes in the formations, extending perpendicular to a main downhole direction, or in non-vertical or horizontal boreholes using lateral perforations or drainholes.

11. A method as claimed in claim 9, further comprising installing sensors in one or more wellbores of an oil and/or gas field, monitoring pressure measurements over time from all of the installed sensors while generating pressure pulses in one or more surrounding wells so as to perturb the pressure in the reservoir.

12. A method as claimed in claim 9, further comprising receiving pressure measurement data to a data acquisition means transmitted from the sensor;

and interpreting data from a data interpretation means.

13. A method as claimed in claim 12, further comprising conducting the pressure measurements in formations surrounding an open hole wellbore or a cased wellbore.

* * * * *